US008302758B2

(12) United States Patent
Martinez et al.

(10) Patent No.: US 8,302,758 B2
(45) Date of Patent: Nov. 6, 2012

(54) COIN PROCESSING SYSTEM

(75) Inventors: Alberto Martinez, Solothurn (CH); Christoph Streit, Spiez (CH)

(73) Assignee: ACS Solutions Switzerland AG, Bern (CH)

( * ) Notice: Subject to any disclaimer, the term of this patent is extended or adjusted under 35 U.S.C. 154(b) by 191 days.

(21) Appl. No.: 12/746,304

(22) PCT Filed: Dec. 4, 2008

(86) PCT No.: PCT/CH2008/000513

§ 371 (c)(1),
(2), (4) Date: Jul. 13, 2010

(87) PCT Pub. No.: WO2009/070908

PCT Pub. Date: Jun. 11, 2009

(65) Prior Publication Data

US 2010/0273408 A1 Oct. 28, 2010

(30) Foreign Application Priority Data

Dec. 7, 2007 (EP) ..... 07405348

(51) Int. Cl.
*G07D 7/00* (2006.01)
*G07D 1/00* (2006.01)
*G07F 1/00* (2006.01)

(52) U.S. Cl. ..... 194/302; 194/344

(58) Field of Classification Search ..... 194/302, 194/344, 350, 351, 346; 453/39, 40, 49, 453/57, 58; 206/0.8, 0.81, 0.83; 221/69, 221/76, 77, 82, 83, 88; 463/46; 232/1 D, 232/55, 56, 60

See application file for complete search history.

(56) References Cited

U.S. PATENT DOCUMENTS 3,415,256 A * 12/1968 Meloni ..... 453/41
4,836,825 A * 6/1989 Smeets et al. ..... 453/49
6,712,688 B2 * 3/2004 McGinty et al. ..... 453/57

FOREIGN PATENT DOCUMENTS

WO WO 2005/057509 A1 6/2005

* cited by examiner

*Primary Examiner* — Mark Beauchaine
(74) *Attorney, Agent, or Firm* — Birch, Stewart, Kolasch & Birch, LLC

(57) ABSTRACT

According to the invention, a coin processing system comprises a coin verifier (2) and a ring-shaped coin magazine (1), in particular a coin magazine (1) which forms an annulus. The coin magazine (1) comprises a coin input (4) fed by the coin verifier (2), a plurality of coin supports (7.1 . . . 7.5) for separately storing a plurality of coins (12.1 . . . 12.3) and a coin output (15). The coin processing system is further characterized in that the coin verifier (2) is at least partly situated within the cavity (13) defined by the ring-shaped coin magazine (1). Further a method for feeding a ring-shaped coin magazine (1) is presented, whereas the coin magazine (1) defines a cavity (13). In particular a method for feeding a coin magazine (1) which forms an annulus is disclosed, wherein the coin magazine (1) comprises a coin input (4) fed by a coin verifier (2), a plurality of coin supports (7.1 . . . 7.5) for separately storing a plurality of coins (12.1 . . . 12.3) and a coin output (15). The method is characterized in that a coin (12.1 . . . 12.3) being released from the coin verifier (2) is directly fed into the magazine (1) from the cavity (13) being defined by the ring-shaped magazine (1) in a first radially outward pointing direction. Further the coin (12.1 . . . 12.3) is stored within the magazine (1) and eventually the coin (12.1 . . . 12.3) is released from the magazine (1) in a second radially outward pointing direction.

14 Claims, 2 Drawing Sheets

COIN PROCESSING SYSTEM

TECHNICAL FIELD

The invention relates to a coin processing system comprising a coin verifier and a ring-shaped coin magazine, in particular a coin magazine which forms an annulus, wherein the coin magazine comprises a coin input fed by the coin verifier, a plurality of coin supports for storing a plurality of coins and a coin output. The invention further relates to a method for feeding such a coin magazine as well as for releasing a coin from it.

BACKGROUND ART

Coin processing systems comprise a plurality of elements. In particular they may comprise an element to verify the value or authenticity of a coin as well as a storage device. Such a storage device or magazine might be formed as a ring-shaped drum or annulus with a plurality of coin supporting sections, whereas each section can house one coin. Usually, there is a respective drum for each kind of coin. Further, coins usually are handled by guiding them under the influence of gravity through the processing system. For the time being, coin processing systems are extending vertically over a relatively large distance meaning that a difference between a coin feeding height and a coin releasing height of the processing system is relatively large.

The publication WO/057509 A1 (Teknowledge Group) discloses a device for storing and handling of coins. The device comprises two or more ring-shaped drums which are mounted in a pivotable manner. The drums are driven by a step motor and a worm gear. The coins may be transferred between the drums by means of a transfer device located in the cavity within the ring-shaped drums. A coin is released from a first drum in an upper section of the first drum and is guided to a lower section of a second drum in order to be fed into it. The disclosed mechanism allows switching the position of coins within the storage apparatus. A coin is fed into the storage apparatus from an upper peripheral sided position and released from it to a lower peripheral sided position.

In prior art devices the coin inlet is at quite a distance above the coin release. Such a large vertical distance leads to rather high and bulky constructions of an apparatus equipped with coin processing devices. This has a negative effect on the comfort of use by handicapped people or children as these persons might not be able to reach a rather high coin inlet and a considerable lower coin release at a time.

SUMMARY OF THE INVENTION

The object of the invention is to create a coin processing device the coin inlet and the coin release of which are close to each other.

The object is fulfilled by the features of claim 1. According to the invention, the coin verifier is situated substantially within the cavity defined by the ring-shaped coin magazine. The invention is not limited to arrangements where the coin verifier is situated completely within the cavity. The object of the invention may also be fulfilled if the coin verifier device is situated at least partly within the cavity.

Since the verifier is placed at least partly within the cavity defined by the ring-shaped coin magazine, it is possible to provide an apparatus wherein the coin can be fed into the verifier at a level which is lower than the highest point of the magazine. Therefore, the vertical extent of the coin processing device may be reduced considerably. This results in the possibility to construct a coin processing device, the coin inlet and coin release of which are close to each other while still using gravity for advancing the coin within the verifier. Therefore, it is possible to produce an apparatus that suits tall persons as well as handicapped persons and children.

In a preferred embodiment, the coin input and the coin output are arranged pointing radially towards the cavity and towards the peripheral side of the coin magazine, respectively. This means that the coin input is arranged pointing radially towards the cavity such that a coin input direction points from inside the cavity radially towards the magazine and the coin output is arranged pointing radially towards the peripheral side of the coin magazine such that a coin output direction points radially outward of the ring-shaped magazine. Advantageously, a coin can be fed into and released from the magazine using gravitational force only. The coin input and coin output can be arranged such that they are located in the same section of the ring-shaped coin magazine as well as such that they are separated or located within opposite sections of the ring-shaped coin magazine.

The coin input and coin output may be arranged differently. An opening which acts as coin input or coin output can also be arranged axially with respect to the coin magazine whereas axial means perpendicular to all radial directions. Further, the coin output may be arranged towards the cavity of the coin magazine within a different section from the section of the coin input so the coin input and the coin output point towards the cavity. For example, the input can be arranged in a lower section of the ring-shaped coin magazine pointing in a radial direction upwards into the cavity and the output can be arranged in an upper section of the magazine pointing radially downwards into the cavity. That means that the coin is lifted from the lower section to the upper section by revolving the coin magazine.

In a further preferred embodiment of the invention the coin magazine and the coin verifier are arranged such that the coin verifier feeds the coin magazine in a substantially radial direction from the cavity defined by the coin magazine. In a preferred embodiment each coin is released from the coin magazine in a direction pointing radially to the surroundings of the coin magazine. An advantage of this way of feeding the coin into and releasing it from the coin magazine, respectively, is that the coin can be fed into and released from of the magazine only using gravitational force.

Alternatively, the coin verifier may feed the coin magazine from outside the cavity. The coin may also be released towards the cavity from an upper section of the ring-shaped coin magazine. It is possible that the coin is fed into the coin magazine or released from the coin magazine in an axial direction as well.

In a preferred embodiment the coin magazine is mounted pivotally about a horizontally oriented geometric axis. Mounting the coin magazine pivotally about a horizontally oriented virtual axis allows a rather compact way of assembling the verifier and the magazine. A ring-shaped coin magazine being mounted pivotally about a vertically oriented axis would need more room as the preferred embodiment. A further advantage of mounting the coin magazine pivotally about a horizontally oriented virtual axis is that the radially arranged input and output of the coin magazine can be oriented vertically, which simplifies using gravitational force for moving and guiding the coins.

Alternatively it is also possible to mount the coin magazine pivotally about a vertical axis or about a skew axis.

In a further preferred embodiment the coin magazine is supported peripherally. Being supported peripherally means that the magazine is supported from outside of the cavity being defined by the ring-shaped magazine. Therefore the magazine is not revolving about a physical axis in its centre but about a virtual axis. The peripheral support of the coin magazine can be achieved by using rollers that are attached peripherally to the magazine.

The advantage of this peripheral support is that within the ring-shaped cavity of the magazine there is no axis necessary. This means that the cavity offers more room for the verifier being at least partly situated within the cavity or other elements which may be placed inside the cavity.

Alternatively the coin magazine can also be supported from inside of the cavity. It is also possible that the magazine revolves about a physical axis in the centre of the ring-shaped coin magazine.

In a further preferred embodiment, the coin magazine is driven by endless coupling means, in particular by a tooth belt. Driving the magazine by endless coupling means allows for separating the driving force or driving wheel, in particular a driving motor, from the magazine. Endless coupling means, preferably a tooth belt, are relatively cheap and rather simple to apply to the system. By driving the coin magazine by a motor a high precision of the movement of it can be achieved.

Alternatively other coupling means can be used to transfer a driving force to the magazine such as tooth wheels or a direct connection of the magazine to a motor. Endless coupling means other than a tooth belt could be a chain or a driving belt in general.

In a preferred embodiment, a coin is supported such that its faces are essentially radially oriented with respect to the ring-shaped coin magazine. More precisely, the faces are oriented radially and parallel to the geometric axis of the ring-shaped magazine so their normal points in an essentially circumferential direction. Each coin support—or stall—defines a segment of circle of the ring-shaped magazine which preferably is as small as possible and each of which contains one coin at a time. This arrangement of coin supports ensures an optimised usage of the space available inside of the coin magazine and an optimised handling of the coins to be fed into or released from the magazine.

Alternatively, a coin can also be supported in a different orientation.

In a further preferred embodiment the azimuthal orientation of a coin with respect to the respective coin support is essentially fixed. This means that the coin essentially does not change its orientation inside of the support during movement of the coin magazine but essentially keeps its relative position inside the support. With respect to the environment, each coin turns with the coin support and therefore with the magazine.

Alternatively, the coins can also be supported such that their orientation is not fixed during movement of the coin magazine.

In a preferred embodiment the coin magazine comprises two separate ring-shaped bodies such as two separate annular bodies. The two ring-shaped bodies may be connected to rotate synchronously about the same geometric axis. Alternatively each of them may have an independent drive. Using two ring-shaped bodies improves the storage capacity of the system. In particular feeding and releasing of coins can be performed faster than with just one ring-shaped body.

When the magazine comprises just one single ring-shaped body, the space required by the system is minimal. When exactly two ring-shaped bodies are used, the required space is still relatively small while the storing capacity is doubled compared to a "single-ring" system. In addition, if two ring-shaped storage containers are used, the cavity defined within the two annular bodies is sufficiently big to fully enclose the coin verifier.

According to the invention, a method for feeding a ring-shaped coin magazine defining a cavity, in particular a coin magazine which forms an annulus, wherein the coin magazine comprises a coin input fed by a coin verifier, a plurality of coin supports for separately storing a plurality of coins and a coin output comprises the following steps: A coin being released from the coin verifier is directly fed into the magazine from the cavity which is defined by the ring-shaped magazine in a first radially outward pointing direction. It further comprises the steps that the coin is stored within the magazine and that the coin is released from the magazine in a second radially outward pointing direction. Feeding the coin directly means that the coin is guided directly from the coin verifier into the magazine without being switched or processed in between. Such a method is particularly efficient as the coin verifier is positioned at least partly within the cavity of the ring-shaped coin magazine. If equipped with an appropriate number of coin release openings, the coin verifier does not need a complex guiding system for the coins to let the coins be guided into a position for feeding the magazine. Therefore room and time for feeding the magazine can be saved in such an embodiment of a coin processing system when using the advantage of the respective arrangement of coin verifier and magazine.

Preferably, the first radially outward pointing direction and the second one are equal to each other. This means that a coin is fed into the magazine and released from it in the same direction. Advantageously, the magazine does not need to move if a coin is not accepted by the verifier. In this case, the verifier feeds the coin into the magazine which immediately releases the coin. This method ensures the possibility that a coin can fall through the magazine without being stored.

Alternatively, it is also possible that the first and the second direction are different from each other. In this case, e.g. if a coin is not acceptable, the magazine needs to move after being fed in order to bring the coin to be released into the appropriate position.

A preferred method is further characterised in that a control mechanism memorises the position of the coin in the magazine. The memorising of the position of each coin is of particular interest for releasing a certain value of change. When the positions of the respective coins are memorised, the magazine can determine the positions of certain coins to be released.

Alternatively such a memorising is not necessary. If all stored coins are of the same type, then the memorising of the position of the coins is not essential.

From the following detailed description and the sum of patent claims, further preferred embodiments and combinations of features of the invention arise.

BRIEF DESCRIPTION OF THE DRAWINGS

The drawings for illustration of the preferred embodiments show.

In general, equal parts are identified with identical numerals.

PREFERRED EMBODIMENTS

Figure 1:
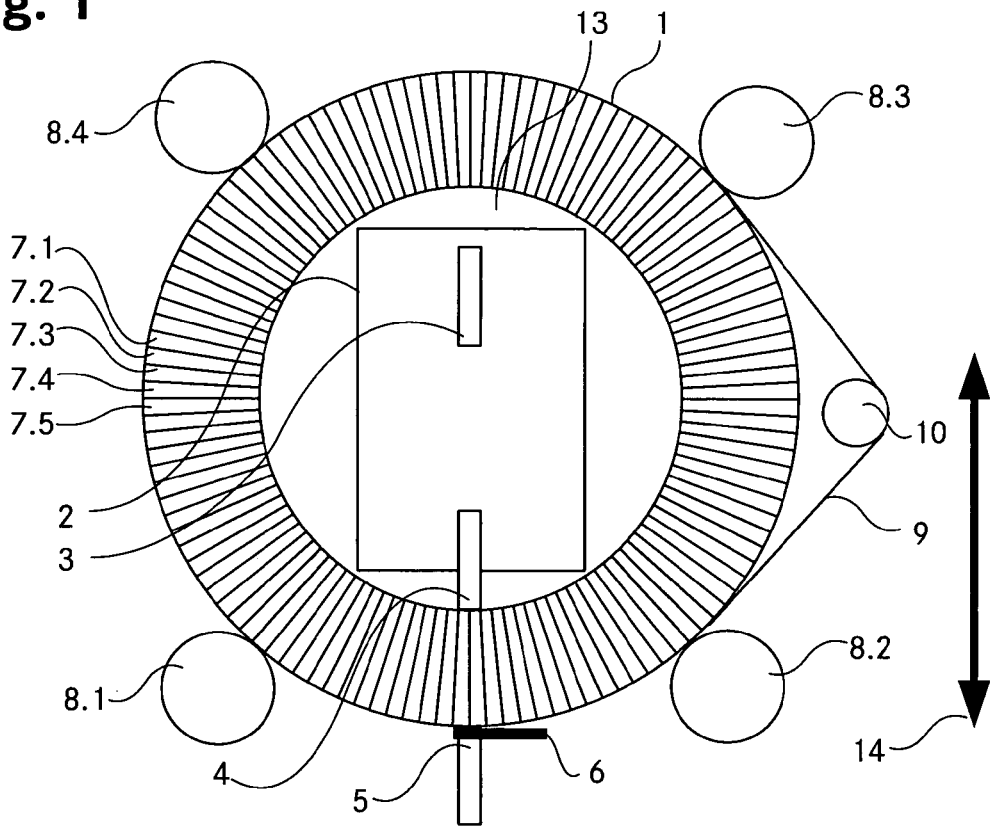
FIG. 1 the coin processing system comprising a coin verifier and a coin magazine in a front view.

FIG. 1 shows the coin processing system in a front view. The ring-shaped coin magazine 1 is defining a cylindrical cavity 13 within which a box-shaped coin verifier 2 is placed. The coin verifier 2 and the magazine 1 are dimensioned such that the coin verifier 2 can be housed in the cavity 13. The verifier 2 is placed centrally in the cavity 13. Further, the verifier 2 comprises a coin inlet opening 3 and a coin input 4 for feeding the coin magazine 1. The coin magazine 1 comprises a plurality of coin supports 7.1, 7.2, . . . which can be fed by the verifier 2 via the coin input 4 in a direction pointing radially outwards from the cavity 13. At the circumferential outside of the ring-shaped coin magazine 1 is the coin output guide 5 of the coin magazine 1. Conceptually speaking, the coin moves in a radial direction pointing outwards "through" an annular section of the coin magazine 1. The vertical distance 14 between the coin inlet opening 3 and the coin output guide 5 is less than the diameter of the magazine 1.

Whether or not a coin is released depends on the position of the shutter 6 which is situated peripherally at the lowest section of the coin magazine 1. The shutter 6 is positioned between the coin magazine 1 and the coin output guide 5.

The whole coin magazine 1 is supported by four rollers 8.1 . . . 8.4, which are distributed over the circumference of the coin magazine 1. The coin magazine 1 is driven by means of a tooth belt 9, which is in interaction with a drive wheel 10. The number of coin supports 7.1, 7.2 . . . is e.g. 120, but may be chosen differently. Usually, there are between 60 and 120 coin supports per drum but depending on the size of each drum more or less supports per drum are possible. The magazine usually has a diameter of between 12 cm and 20 cm and is formed as a drum in a well known manner. As an alternative to drums, the magazine can also be formed by plain coil chains.

Figure 2:
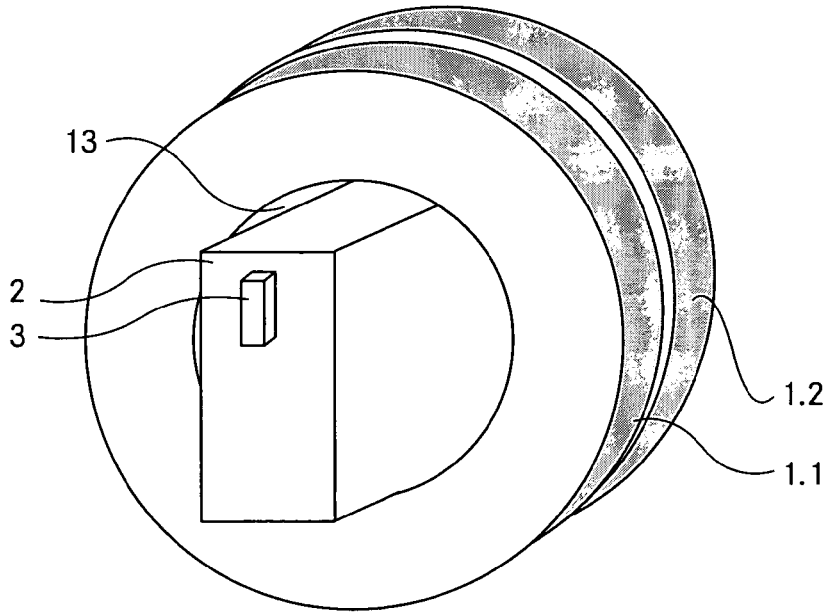
FIG. 2 a perspective view of the system.

FIG. 2 also shows a perspective view of the coin processing system. The two drums 1.1, 1.2 are axially adjacent to but separated from each other. Inside of the cavity 13 defined by the drums 1.1 and 1.2 is the box-shaped coin verifier 2. The coin verifier 2 is placed partially inside the cavity defined by the drums 1.1, 1.2, which means that a part of the coin verifier 2 extends into the cavity 13 of the two drums 1.1, 1.2. The verifier 2 is essentially placed inside the drums 1.1, 1.2 which means that the main part of the verifier 2 is housed in the cavity 13 but minor parts of the coin verifier 2 may not be enclosed by the drums. The coin inlet opening 3 of the verifier 2 and an adjacent part of the verifier 2 can be positioned outside of the cavity 13. However, the specific part of the verifier 2 which feeds the drums 1.1, 1.2 needs to be placed inside the cavity 13.

Figure 3:
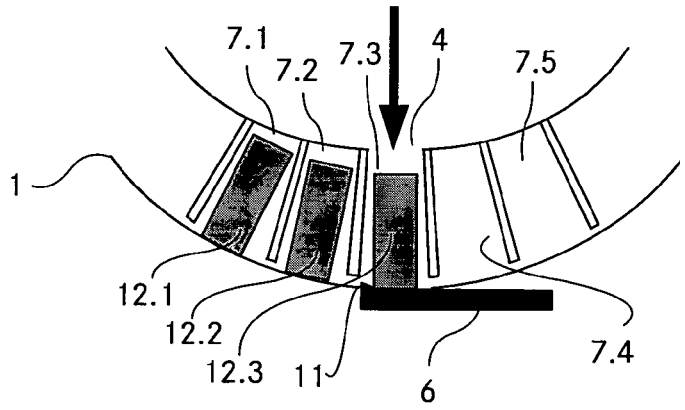
FIG. 3 a section of the ring-shaped magazine when inserting a coin.

FIG. 3 shows a section of a ring-shaped coin magazine 1 with a coin input 4 opening. The coin magazine 1 is oriented such that a virtual axis about which the magazine may be rotated has a horizontal direction. The coin magazine 1 comprises a plurality of coin supports 7.1, 7.2, . . . . In the drawing three of the coin supports 7.1, 7.2, 7.3 contain a coin 12.1 . . . 12.3. A shutter 6 is positioned opposite the coin input 4 at the peripheral side of the coin magazine 1. The shutter 6 is shown in FIG. 3 in a closed position and is attached to the circumference of the ring-shaped coin magazine 1 tangential to the lowest point of the magazine 1 and essentially formed as a horizontally extending cuboid. It comprises a nose 11 at one edge pointing towards the magazine. The function of this nose is to make sure that a jamming of the magazine by a coin during revolving the magazine is prevented. The coin 12.3 is fed into the magazine 1 via the coin input 4 which is situated at the lowest point of the ring-shaped magazine. Each support 7.1, 7.2, . . . is dimensioned such that a coin can be retained in it and the orientation of which is essentially fixed with respect to the support.

Figure 4:
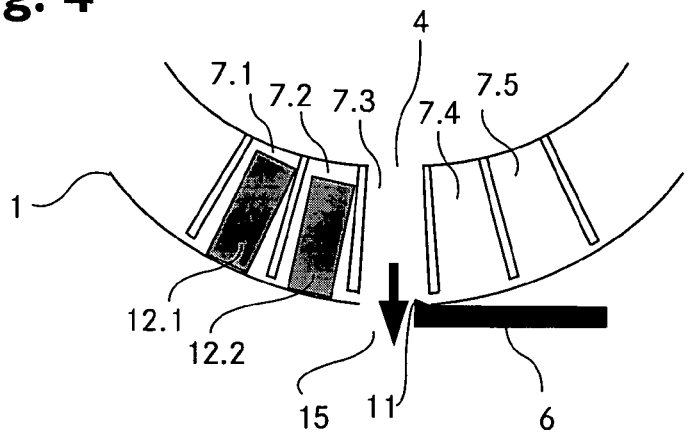
FIG. 4 a section of the ring-shaped magazine when dispensing a coin.

Similarly, FIG. 4 shows the same section of the magazine 1 as FIG. 3 but with an opened shutter 6 for outputting the coin. In this position, the shutter does not close the magazine anymore and a coin being contained inside the support 7.3 is released by falling out of the support 7.3 through the coin output 15 following the gravitational force. If the shutter 6 is in this position when a coin is fed into the magazine 1, the coin just falls through the magazine and is immediately released.

Figure 5:
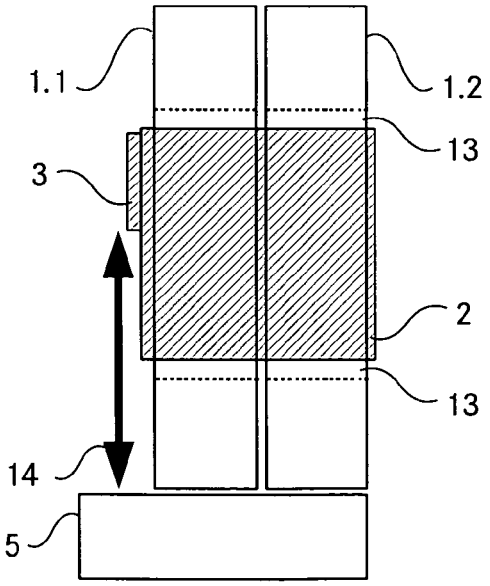
FIG. 5 a side view of the coin processing system.

FIG. 5 shows a side view of the coin processing system of FIGS. 1 and 2. The coin verifier 2 is partly situated inside the cavity 13 of the two drums 1.1 and 1.2. Partly inside the cavity 13 means that at least a part of the verifier 2 is enclosed by a drum 1.1 or 1.2. In FIG. 5, the vertical distance 14 between the coin inlet 3 and the coin output guide 5 of the magazine is shown as in FIG. 1. The two drums 1.1 and 1.2 are arranged coaxially but separated from one another. The coin verifier 2 sits centrally in the cavity 13 of the two drums 1.1, 1.2. Each drum 1.1, 1.2 encloses a part of the coin verifier 2. In this configuration, a coin being released from the coin verifier 2 can be fed in one of the respective drums 1.1, 1.2 without being further guided or processed.

The usage of two drums—as opposed to a plurality of drums where each drum is filled with one type of coins only—arouses the need of precisely memorising the position of each coin in the drums because the type of a coin is not determined by the drum anymore. As coins are not sorted by values but fed into the drums as they come, a control mechanism needs to memorise the position of each coin in order to determine the coins to be released for a certain amount of change and their position within the magazine.

Compared to tube magazines, the drum magazines show the advantage that they are less susceptible to money laundering. If a user of the coin processing system cancels the operation, the identical coin that has been fed into the system can be released from the magazine. Therefore a physical exchange of coins is prevented by the kind of magazine. Eventually, the system has an advantage if compared to multi drum magazines in terms of expenses as it uses fewer parts than those systems.

In conclusion, the invention presents a coin processing system the coin feeder and the coin release of which are closer to each other than possible in prior art constructions.

The invention claimed is:

1. A coin processing system comprising:
a coin verifier and
a ring shaped coin magazine,
wherein the coin magazine includes
a coin input fed by the coin verifier,
a plurality of coin supports for separately storing a plurality of coins and
a coin output,
wherein the coin verifier is at least partly situated within a cavity defined by the ring-shaped coin magazine.

2. The coin processing system as recited in claim 1, wherein the coin input and the coin output are arranged pointing radially towards the cavity and/or towards a peripheral side of the coin magazine, respectively.

3. The coin processing system as recited in claim 1, wherein the coin magazine and the coin verifier are arranged such that the coin verifier feeds the coin magazine from the cavity defined by the coin magazine and that each coin is released from the coin magazine in a radial peripheral side direction.

4. The coin processing system as recited in claim 1, wherein the coin magazine is mounted pivotally about a horizontally oriented virtual axis.

5. The coin processing system as recited in claim 1, wherein the coin magazine is peripherally supported.

6. The coin processing system as recited in claim 1, wherein the coin magazine is driven by endless coupling means.

7. The coin processing system as recited in claim 6, wherein the endless coupling means is a tooth belt.

8. The coin processing system as recited in claim 1, wherein a coin is supported such that the faces of the coin are essentially radially oriented with respect to the ring shaped coin magazine.

9. The coin processing system as recited in claim 1, wherein the azimuthal orientation of a coin with respect to the respective coin support is essentially fixed.

10. The coin processing system as recited in claim 1, wherein the coin magazine comprises two separate annular bodies.

11. The coin processing system as recited in claim 1, wherein the coin magazine forms an annulus.

12. A method for feeding a ring-shaped coin magazine, wherein the coin magazine defines a cavity and wherein the coin magazine comprises a coin input fed by a coin verifier, a plurality of coin supports for separately storing a plurality of coins and a coin output, the method comprising the steps of:

releasing a coin from the coin verifier;

feeding the released coin directly into the magazine from the cavity being defined by the ring-shaped magazine in a first radially outward pointing direction;

storing the coin within the magazine and;

releasing the coin from the magazine in a second radially outward pointing direction.

13. The method of claim 12, wherein the coin is fed into the magazine and released from the magazine in the same direction.

14. The method of claim 12, the method further comprising memorizing the position of the coin in the magazine with a control mechanism.

* * * * *